US006986163B2

(12) United States Patent
Dugan

(10) Patent No.: US 6,986,163 B2
(45) Date of Patent: Jan. 17, 2006

(54) BABY BATH WRAP

(76) Inventor: Tara Jean Dugan, 121 Hadley's Mill Run, Kennett Square, PA (US) 19348

( * ) Notice: Subject to any disclaimer, the term of this patent is extended or adjusted under 35 U.S.C. 154(b) by 71 days.

(21) Appl. No.: 10/283,579

(22) Filed: Oct. 30, 2002

(65) Prior Publication Data

US 2003/0079267 A1 May 1, 2003

Related U.S. Application Data

(60) Provisional application No. 60/339,716, filed on Nov. 1, 2001.

(51) Int. Cl.
*A41D 13/04* (2006.01)

(52) U.S. Cl. ..... 2/69; 2/48

(58) Field of Classification Search ..... 2/69, 2/48, 88, 67, 49.1, 49.2, 49.3, 49.4, 49.5, 2/50, 51, 52, 104, 111, 207; D2/861, 860; 5/655; 15/208, 209.1, 210.1
See application file for complete search history.

(56) References Cited

U.S. PATENT DOCUMENTS

| | | | | | |
|---|---|---|---|---|---|
| 1,151,126 | A | * | 8/1915 | Robinson | 2/91 |
| 1,405,744 | A | * | 2/1922 | Sampliner | 2/91 |
| 1,990,568 | A | * | 2/1935 | Scheidler | 15/222 |
| 2,413,319 | A | * | 12/1946 | Golfieri | 2/171.01 |
| 2,421,934 | A | * | 6/1947 | Golfieri | 2/204 |
| 2,501,010 | A | * | 3/1950 | Seidenbaum | 2/48 |
| 2,617,105 | A | * | 11/1952 | Backman | 2/48 |
| 2,674,738 | A | * | 4/1954 | Mehlos | 2/48 |
| 2,706,817 | A | * | 4/1955 | Schneider | 2/84 |
| 2,722,685 | A | * | 11/1955 | Lucas | 2/48 |
| 2,879,514 | A | * | 3/1959 | Shapiro | 2/48 |
| 3,013,274 | A | * | 12/1961 | Dike | 2/69 |
| 3,160,892 | A | * | 12/1964 | Semons | 2/88 |
| D212,581 | S | * | 11/1968 | Ratay | D2/864 |
| 3,629,865 | A | * | 12/1971 | Weiner | 2/48 |
| 3,751,730 | A | * | 8/1973 | Zamist | 2/114 |
| 3,840,899 | A | * | 10/1974 | Saxena | 2/74 |
| 4,215,434 | A | * | 8/1980 | Barron | 2/114 |
| 4,285,067 | A | * | 8/1981 | David | 2/46 |
| D275,827 | S | * | 10/1984 | Henry | D6/608 |
| 4,565,144 | A | * | 1/1986 | Ricci | 112/437 |
| 4,631,754 | A | * | 12/1986 | Ryan | 2/104 |
| 4,656,670 | A | * | 4/1987 | Schluter | 2/92 |
| 4,685,154 | A | * | 8/1987 | Smith | 2/48 |
| 4,706,303 | A | * | 11/1987 | Van Gompel et al. | 2/49.2 |
| 4,712,251 | A | * | 12/1987 | Cobble | 2/49 |
| 4,873,725 | A | * | 10/1989 | Mitchell | 2/48 |
| 5,479,662 | A | * | 1/1996 | Runco | 2/104 |
| D396,338 | S | * | 7/1998 | Yang | D2/500 |
| 5,797,142 | A | * | 8/1998 | Debronsky et al. | 2/69 |
| 5,797,144 | A | * | 8/1998 | Ciccone | 2/144 |
| D398,140 | S | * | 9/1998 | Lion | D2/861 |
| 6,006,356 | A | * | 12/1999 | Song | 2/69 |
| 6,065,156 | A | * | 5/2000 | Murphy | 2/207 |
| 6,175,964 | B1 | * | 1/2001 | Adler | 2/207 |
| 6,301,713 | B1 | * | 10/2001 | Aceves et al. | 2/104 |
| 6,351,869 | B1 | * | 3/2002 | Jones | 15/209.1 |
| 6,505,367 | B2 | * | 1/2003 | Griffin et al. | 5/655 |

* cited by examiner

*Primary Examiner*—John J. Calvert
*Assistant Examiner*—Alissa L. Hoey
(74) *Attorney, Agent, or Firm*—Caesar, Rivise, Bernstein, Cohen & Pokotilow, Ltd.

(57) ABSTRACT

A modified towel for use while bathing, lifting and drying babies, where the towel wraps around the caregivers body and remains there securely. It is constructed of absorbent fabric and shaped like a tapered rectangle or elongated trapezoid, with a slit near the tapered end. The tapered end of the towel wrap drapes over one shoulder and is secured in the hip region by pulling either corner through the slit. The wrap is worn while bathing an infant, and is easily transferred from adult caregiver to baby for drying when the bath is done.

1 Claim, 2 Drawing Sheets

BABY BATH WRAP

CROSS-REFERENCE TO RELATED APPLICATIONS

This application claims the benefit of provisional application No. 60/339,716 filed Nov. 1, 2001.

STATEMENT REGARDING FEDERALLY SPONSORED RESEARCH OR DEVELOPMENT

N/A

BACKGROUND—FIELD OF INVENTION

This invention relates to bath accessories generally, specifically to an improved towel for bathing and drying infants.

BACKGROUND—DESCRIPTION OF PRIOR ART

Bathing a baby is a difficult chore that frequently results in both the baby and caregiver getting soaked. Babies love to splash and play in the tub, and when they do the parent or caregiver gets wet. Because the baby's safety is always of paramount concern, the caregiver must necessarily have his or her hands on the baby at all times to ensure that the baby does not slip into the bathwater. This places the caregiver in close proximity to the tub, where he or she cannot avoid getting soaked by the baby's splashing. More important, however, are the safety concerns that arise when removing the baby from the water after the bath. The act of taking a slippery, wet baby out of the tub and into the arms of the caregiver gets the caregiver wet again, as the baby must necessarily be held securely against the caregiver's body to safely lift the child from the water. The caregiver must manage to locate a towel and reach for it while keeping a grip on the slippery baby. This is inevitably a dicey proposition for the adult bather, who must take their eyes and at least one hand off the baby in order to find and grab the towel. Once a towel is located, the caregiver must attempt to wrap is quickly around the baby without getting it into the bath water. Invariably, this entire process results in a wet, chilly baby and a wet parent as well. Moreover, the bathroom floor can become slick and dangerous from the dripping water.

To address these concerns and safety issues, there is a need for a modified bath towel that can be worn by the adult during the bath, and then transferred in one effortless motion to the baby for drying and wrapping the infant securely. This towel will serve the dual purpose of keeping the adult's clothing dry during the baby's bath, and being readily available to dry and snuggle to freshly bathed infant.

Previous towel designs are unsuited to address the issues raised. Even towels made specifically for bathing infants are unsuitable. U.S. Pat. No. 6,156,410, issued to Bassler on Dec. 5, 2000 is a hooded towel capable of being monogrammed. This does not deal with the problem of the caregiver getting wet, or of the need to keep the towel handy during the baby's bath to reduce the risk of injury. The same is true for similar designs, including U.S. Pat. No. 6,389,597, issued to Henegan on May 21, 2002 for a hooded towel which folds over at the bottom, and U.S. Pat. No. D398,140 issued to Lion on Sep. 15, 1998 for an apron towel which cannot be transferred and used to dry baby easily. Application 20010029631, Griffin, filed Mar. 8, 2001, describes a complex device which is capable of being worn during the bath, but it involves a neck loop and fasteners that make it impractical and potentially dangerous as a drying device.

The present invention addresses the need to have a baby's bath towel kept handy during bathtime, and the fact that this absorbent article is actually worn by the caregiver to keep it handy serves a dual purpose: the caregiver is protected from the bathwater and the towel is kept convenient by wearing it. The bather never has to turn his or her attention away from the baby. Moreover, the simple one piece, one material construction mean that it is perfect for drying the baby. There are no fasteners to scratch or irritate the infant's tender skin, and there are no strings, loops, ties or other parts that could pose a risk of choking a baby. This new and unobvious invention achieves its dual purpose by using only fabric, which makes this invention easy and inexpensive to manufacture.

SUMMARY

The objects and advantages of the present invention, the baby bath wrap, are:

a. To provide a wrap that is worn by the adult caregiver while bathing, removing from the bath, and drying an infant or small child, which serves to keep the caregiver dry while performing these tasks;
b. By making the present invention from terry cloth or other absorbent fabric appropriate for use as a bath towel, the baby bath wrap serves as a drying device for the baby;
c. To provide a towel that, by its design, is capable of being worn by the adult caregiver, which eliminates the need to search for or reach for a towel while the infant is in or near the bath water, thereby increasing safety;
d. To provide a towel that is immediately available to the caregiver to dry and securely wrap the baby as soon as possible after baby's removal from the tub, thereby reducing the chill, which is especially important with newborn babies;
e. The adult's shoulder, covered by the baby bath wrap, becomes a comfortable and secure drying surface for the baby to be lifted onto immediately after the bath, without soaking the adult;
f. The construction of the present invention without the need for fasteners, ties, straps, elastic or any material other than absorbent fabric makes it perfectly suited for use drying the infant after the bath, without the potential to scratch the baby's skin with a fastening device or choke the baby with a strap or tie.
g. The construction of the present invention from fabric alone makes it safe, simple, cost effective and attractive.

BRIEF DESCRIPTION OF DRAWINGS

There are two drawings submitted.

Drawing 1 shows the invention from the user's perspective, as though it were laid out flat on a table or floor. Slit 1 is the slit near the tapered end of the baby bath wrap, which either Corner 1 or Corner 2 can be tucked into after the tapered end is draped over the caregiver's shoulder.

Figure 1:
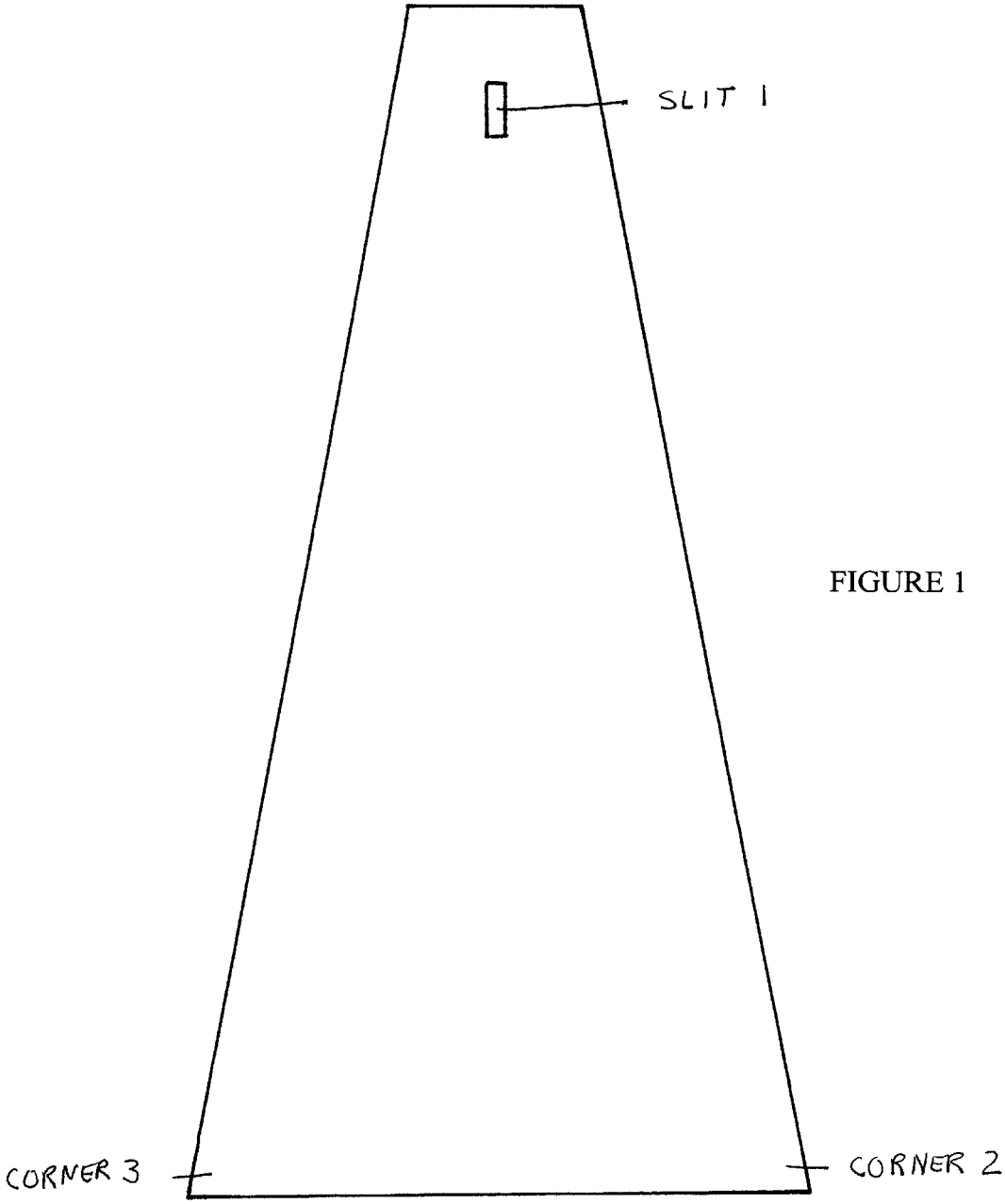
Figure 2:
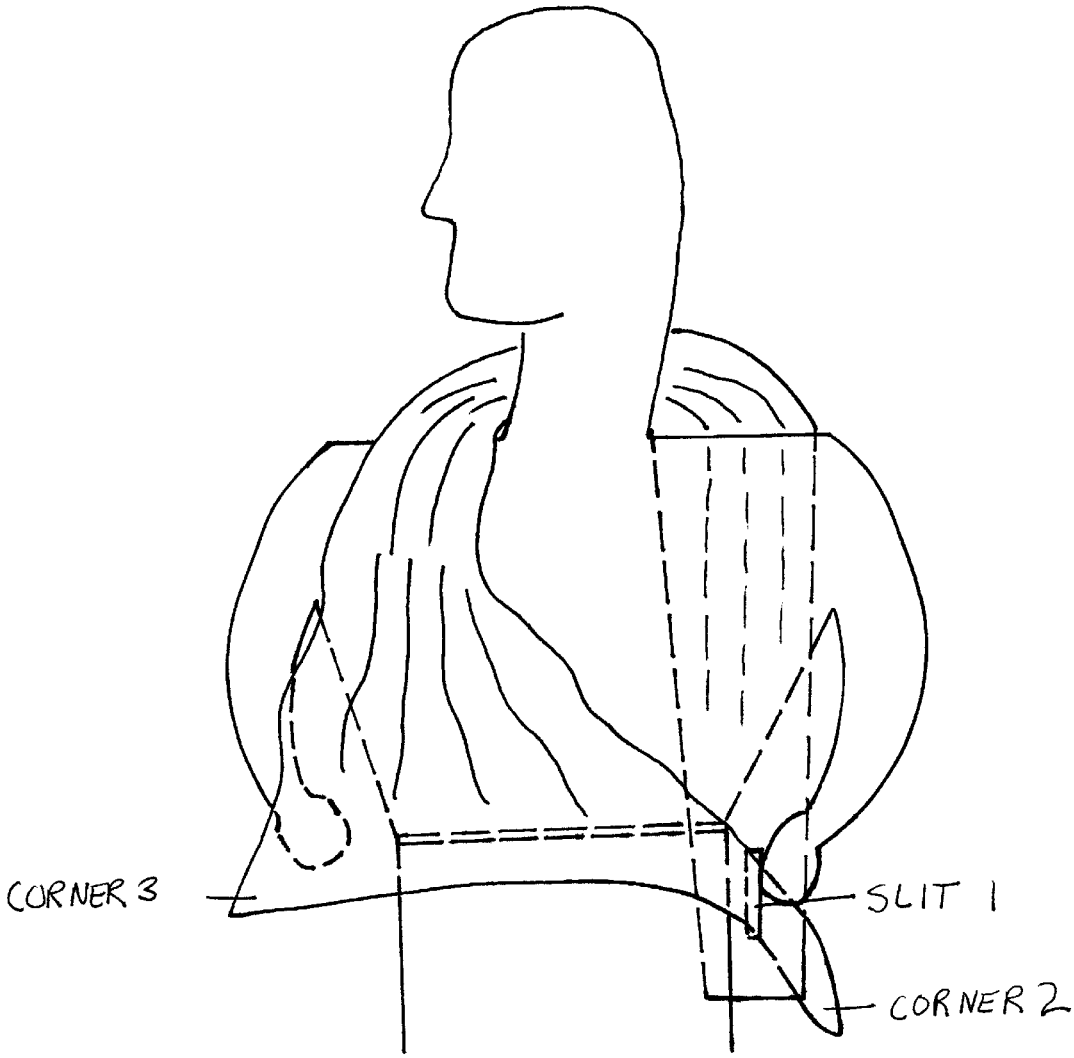

Drawing 2 shows the invention as it appears from the front when worn by an adult caregiver. The tapered end, having been draped over the adult's shoulder and falling to the waist or hip area, is behind the user, while the wider end remains in the front, also falling to the hip area. Corner 2, used when the towel wrap is draped over the adult's right shoulder, is tucked into Slit 1 at the back of the user, and pulled snug to secure the wrap on the body.

DESCRIPTION

This invention is a modified towel, made of absorbent terry cotton or other fabric appropriate to the purpose. While the size and dimensions may be modified to accommodate production or other needs, it is a four-sided item, similar to a large bath towel with a gradual tapering at one end, resulting in an elongated trapezoidal shape. The tapered end has a slit in the center. The slit begins approximately four inches from the tapered end, and is three inches long.

In the preferred embodiment, the wrap is ten inches wide at the top and thirty-four inches across the bottom. In the preferred embodiment, the baby bath wrap is sixty-six inches long. There is a slit opening in the center of the narrower tapered end. Preferably, the slit begins at four inches in from the center of the tapered end on the wrap. It is three inches long, and runs vertically.

Operation

This invention, a modified bath towel, is worn sarong-style over either shoulder of the user and tucked in around the waist to keep it on the body. The wrap is worn over either shoulder of the user to accommodate right- or left-handedness. It is tapered at the top to facilitate the top draping nicely over either shoulder without being too bulky. There is a slit opening at the center of the tapered top (which has now been draped over a shoulder and reaches the user's waist or hip at the back of the body) that will accommodate either corner of the wider end, which now covers the user's front body, being tucked into it at the user's hip or waist area to secure the bath wrap. If the wrap is draped over the left shoulder, then the right corner should be tucked into the slit, and vice versa. Once tucked in and pulled snug, the towel will stay on the user's body and allow him or her to concentrate on safely bathing the baby. There is no need to reach for a towel that had dropped; the baby bath wrap remains conveniently worn on the body during the entire bath. The bath wrap will also serve to keep the user dry during the bath and when baby is lifted out of the bath and against the body of the user.

After the baby is lifted out of the water and against the user, the user simply untucks the corner of the wrap from the slit and wraps baby up safely. There are no ties or fasteners, thereby enabling the whole towel to be used to safely wrap up, snuggle and dry the baby after the bath. The slit where the corner tucks in is small enough to prevent baby's head from going through, thereby preventing a choking hazard.

I claim:

1. A method for releasably securing an elongated piece of fabric to a caregiver who is bathing an infant, said method comprising the steps of:

providing an elongated piece of fabric that tapers from a first end to a second end;

providing an opening at said second end;

placing said elongated piece of fabric over one shoulder on a first side of the caregiver such that said first end is positioned behind the caregiver and said second end is positioned in front of the caregiver;

seizing a first portion of said first end and pulling it towards a second side, opposite the first side, of the caregiver;

seizing a second portion of said second end and pulling it towards said second side of the caregiver; and inserting said first portion into said opening at the waist of the caregiver to releasably secure said elongated piece of fabric to the caregiver.

* * * * *